US009741351B2

(12) United States Patent
Vinton

(10) Patent No.: US 9,741,351 B2
(45) Date of Patent: Aug. 22, 2017

(54) ADAPTIVE QUANTIZATION NOISE FILTERING OF DECODED AUDIO DATA

(71) Applicant: Dolby Laboratories Licensing Corporation, San Francisco, CA (US)

(72) Inventor: Mark S. Vinton, San Francisco, CA (US)

(73) Assignee: Dolby Laboratories Licensing Corporation, San Francisco, CA (US)

( * ) Notice: Subject to any disclaimer, the term of this patent is extended or adjusted under 35 U.S.C. 154(b) by 270 days.

(21) Appl. No.: 14/573,251

(22) Filed: Dec. 17, 2014

(65) Prior Publication Data

US 2015/0179182 A1 Jun. 25, 2015

Related U.S. Application Data

(60) Provisional application No. 61/918,076, filed on Dec. 19, 2013.

(51) Int. Cl.

| | |
|---|---|
| ***G10L 21/02*** | (2013.01) |
| ***G10L 21/0208*** | (2013.01) |
| ***G10L 19/26*** | (2013.01) |
| ***G10L 19/032*** | (2013.01) |
| *G10L 25/03* | (2013.01) |

(52) U.S. Cl.
CPC ..... *G10L 19/032* (2013.01); *G10L 19/26* (2013.01); *G10L 21/02* (2013.01); *G10L 21/0208* (2013.01); *G10L 25/03* (2013.01)

(58) Field of Classification Search
CPC ..... G10L 19/26; G10L 21/0208; G10L 21/02
See application file for complete search history.

(56) References Cited

U.S. PATENT DOCUMENTS

| | | | | |
|---|---|---|---|---|
| 5,774,835 | A | 6/1998 | Ozawa | |
| 6,246,345 | B1 * | 6/2001 | Davidson | G10L 19/0208 341/51 |
| 8,315,863 | B2 * | 11/2012 | Oshikiri | G10L 19/24 370/352 |
| 8,706,507 | B2 | 4/2014 | Vinton | |

(Continued)

FOREIGN PATENT DOCUMENTS

| | | |
|---|---|---|
| EP | 0 785 631 | 7/1997 |
| WO | 2005/078706 | 8/2005 |

(Continued)

*Primary Examiner* — Samuel G Neway

(57) ABSTRACT

A method including steps of decoding an encoded audio signal indicative of encoded audio content (e.g., audio content captured during a teleconference) to generate a decoded signal indicative of a decoded version of the audio content, and performing adaptive quantization noise filtering on the decoded signal. The filtering is performed adaptively in the frequency domain in response to data indicative of signal to noise values in turn indicative of a post-quantization signal-to-quantization noise ratio for each frequency band of each of at least one segment of the encoded audio content. In some embodiments, each signal to noise value is a bit allocation value equal to the number of mantissa bits of an encoded audio sample of a frequency band of a segment of the encoded audio content. Other aspects are decoder, or post-filter coupled to receive a decoder's output, configured to perform an embodiment of the adaptive filtering.

19 Claims, 6 Drawing Sheets

(56) References Cited

U.S. PATENT DOCUMENTS

| | | | | |
|---|---|---|---|---|
| 9,026,451 | B1 * | 5/2015 | Kleijn | G10L 19/26 348/607 |
| 9,384,755 | B2 * | 7/2016 | Vaillancourt | G10L 25/93 |
| 2002/0128822 | A1 * | 9/2002 | Kahn | G10L 21/01 704/200.1 |
| 2006/0271354 | A1 * | 11/2006 | Sun | G10L 19/26 704/205 |
| 2010/0094637 | A1 * | 4/2010 | Vinton | G10L 19/032 704/500 |
| 2010/0161322 | A1 * | 6/2010 | Sung | G10L 19/24 704/205 |
| 2010/0183067 | A1 * | 7/2010 | Garcia | G10L 19/26 375/240 |
| 2011/0046947 | A1 * | 2/2011 | Vaillancourt | G10L 19/26 704/226 |
| 2011/0125507 | A1 * | 5/2011 | Yu | G10L 21/0364 704/500 |
| 2011/0282656 | A1 * | 11/2011 | Grancharov | G10L 19/26 704/203 |
| 2012/0323584 | A1 | 12/2012 | Koishida | |
| 2015/0142425 | A1 * | 5/2015 | Sjoberg | G10L 21/0364 704/226 |
| 2015/0179182 | A1 * | 6/2015 | Vinton | G10L 19/032 704/226 |

FOREIGN PATENT DOCUMENTS

| | | |
|---|---|---|
| WO | 2010/009098 | 1/2010 |
| WO | 2011/048117 | 4/2011 |
| WO | 2011/142709 | 11/2011 |
| WO | 2012/110415 | 8/2012 |

* cited by examiner

ADAPTIVE QUANTIZATION NOISE FILTERING OF DECODED AUDIO DATA

CROSS REFERENCE TO RELATED APPLICATIONS

This application claims the benefit of priority to U.S. Provisional Application Ser. No. 61/918,076, filed on Dec. 19, 2013, which is incorporated herein by reference in its entirety.

FIELD OF THE INVENTION

The invention pertains to audio signal processing, and more particularly, to adaptive filtering of decoded audio signals to reduce audible noise (e.g., pre-echo noise) due to quantization during encoding.

BACKGROUND OF THE INVENTION

In accordance with many conventional audio encoding methods, audio data undergoes quantization (e.g., to compress the audio data during perceptual audio coding). For example, encoding of audio data in accordance with the formats known as AC-3 and Enhanced AC-3 (or "E-AC-3") includes such a quantization step. Dolby Laboratories provides proprietary implementations of AC-3 and E-AC-3 known as Dolby Digital and Dolby Digital Plus, respectively. Dolby, Dolby Digital, and Dolby Digital Plus are trademarks of Dolby Laboratories Licensing Corporation.

Although some embodiments of the present invention are useful to filter audio content of a decoded version of an encoded bitstream having AC-3 (or E-AC-3) format, it is contemplated that other embodiments of the invention are useful to filter audio content of decoded versions of encoded bitstreams having other formats (provided that the encoding includes a quantization step).

Next, with reference to FIG. 1, we describe aspects of conventional AC-3 encoding of audio data, as an example of an encoding method which includes mantissa bit allocation and mantissa value quantization steps.

An encoded bitstream having AC-3 format comprises one to six channels of audio content, and metadata indicative of at least one characteristic of the audio content. The audio content is audio data that has been compressed using perceptual audio coding.

In encoding of an AC-3 audio bitstream, blocks of input audio samples to be encoded undergo time-to-frequency domain transformation resulting in blocks of frequency domain data, commonly referred to as transform coefficients, frequency coefficients, or frequency components, located in uniformly spaced frequency bins. The frequency coefficient in each bin is then converted (e.g., in BFPE stage 7 of the FIG. 1 system) into a floating point format comprising an exponent and a mantissa.

Typical embodiments of AC-3 (and E-AC-3) encoders (and other audio data encoders) implement a psychoacoustic model to analyze the frequency domain data on a banded basis (i.e., typically 50 nonuniform bands approximating the frequency bands of the well known psychoacoustic scale known as the Bark scale) to determine an optimal allocation of bits to each mantissa. The mantissa data is then quantized (e.g., in quantizer 6 of the FIG. 1 system) to a number of bits corresponding to the determined bit allocation. The quantized mantissa data is then formatted (e.g., in formatter 8 of the FIG. 1 system) into an encoded output bitstream. The mantissa bit assignment is based on the difference between a fine-grain signal spectrum (represented by a power spectral density ("PSD") value for each frequency bin) and a coarse-grain masking curve (represented by a mask value for each frequency band determined by the psychoacoustic model).

To perform AC-3 encoding of an audio program, a number, N (e.g., N=1, N=2, or N=4), of quantized mantissa values (one for each of N consecutive frequency bins) which will share the same exponent value is chosen. Each such set of N consecutive frequency bins may also (and herein will) be referred to as a frequency "band" (each band comprising N bins). Thus, one bit allocation value for each frequency band of an encoded audio program (where the bit allocation value is indicative of the number of bits of the mantissa for one bin of the band) suffices to indicate the number of bits of each mantissa of each audio sample in the band. In this context, the frequency bands of the encoded audio program are typically not the same frequency bands assumed by the psychoacoustic model which is employed to determine the number of bits of each quantized mantissa of the encoded program.

FIG. 1 is an encoder configured to perform AC-3 (or Enhanced AC-3) encoding on time-domain input audio data 1. Analysis filter bank 2 converts the time-domain input audio data 1 into frequency domain audio data 3 (samples in a set of frequency bins), and block floating point encoding (BFPE) stage 7 generates a floating point representation of each frequency component of data 3, comprising an exponent and mantissa for each frequency bin. The frequency-domain data output from stage 7 will sometimes also be referred to herein as frequency domain audio data 3. The frequency domain audio data output from stage 7 are then encoded, including by quantization of its mantissas in quantizer 6, and tenting of its exponents (in tenting stage 10) and encoding (in exponent coding stage 11) of the tented exponents generated in stage 10. Formatter 8 generates an AC-3 (or enhanced AC-3) encoded bitstream 9 in response to the quantized data output from quantizer 6 and coded differential exponent data output from stage 11.

Quantizer 6 performs bit allocation and quantization based upon control data (including masking data) generated by controller 4. The masking data (determining a masking curve) is generated from the frequency domain data 3, on the basis of a psychoacoustic model (implemented by controller 4) of human hearing and aural perception. The psychoacoustic modeling takes into account the frequency-dependent thresholds of human hearing, and a psychoacoustic phenomenon referred to as masking, whereby a strong frequency component close to one or more weaker frequency components tends to mask the weaker components, rendering them inaudible to a human listener. This makes it possible to omit the weaker frequency components when encoding audio data, and thereby achieve a higher degree of compression, without adversely affecting the perceived quality of the encoded audio data (bitstream 9). The masking data comprises a masking curve value for each frequency band (determined by the psychoacoustic model) of the frequency domain audio data 3. These masking curve values represent the level of signal masked by the human ear in each frequency band. Quantizer 6 uses this information to decide how best to use the available number of data bits to represent the frequency domain data of each frequency band of the input audio signal.

Controller 4 may implement a conventional low frequency compensation process (sometimes referred to herein as "lowcomp" compensation) to generate lowcomp parameter values for correcting the masking curve values for the low frequency bands. The corrected masking curve values are used to generate the signal-to-mask ratio value for each frequency component of the frequency-domain audio data 3. Low frequency compensation is a feature of the psychoacoustic model typically implemented during AC-3 (and E-AC-3) encoding of audio data. Lowcomp compensation improves the encoding of highly tonal low-frequency components (of the input audio data to be encoded) by preferentially reducing the mask in the relevant frequency region, and in consequence allocating more bits to the code words employed to encode such components.

In AC-3 and E-AC-3 encoding, each component of the frequency-domain audio data 3 (i.e., the contents of each transform bin) has a floating point representation comprising a mantissa and an exponent. To simplify the calculation of the masking curve, the Dolby Digital family of coders uses only the exponents to derive the masking curve. Or, stated alternately, the masking curve depends on the transform coefficient exponent values but is independent of the transform coefficient mantissa values. Because the range of exponents is rather limited (generally, integer values from 0-24), the exponent values are mapped onto a PSD scale with a larger range (generally, integer values from 0-3072) for the purposes of computing the masking curve. Thus, the loudest frequency components are mapped to a PSD value of 3072, while the softest frequency-domain data components are mapped to a PSD value of 0.

In conventional Dolby Digital (or Dolby Digital Plus) encoding, differential exponents (i.e., the difference between consecutive exponents) are coded instead of absolute exponents. The differential exponents can only take on one of five values: 2, 1, 0, −1, and −2. If a differential exponent outside this range is found, one of the exponents being subtracted is modified so that the differential exponent (after the modification) is within the noted range (this conventional method is known as "exponent tenting" or "tenting"). Tenting stage 10 of the FIG. 1 encoder generates tented exponents in response to the raw exponents asserted thereto, by performing such a tenting operation.

Spectral domain coding systems (e.g., conventional encoders of the type described with reference to FIG. 1) code pseudo-stationary audio signals extremely well. However, at low data rates these systems can introduce audible pre-echo artifacts when coding transient signals. Conventional coding methods such as Temporal Noise Shaping (TNS) and Gain Control provide improvements for the coding of transient material by temporally flattening the audio signal prior to quantization (and performance of other encoding steps) and then reapplying the original temporal envelope at the decoder. Thus, the noise introduced by quantization is shifted away from quiet segments of the audio to louder segments of the audio in the time domain. The temporal flattening is performed by applying a filter in the encoder, and the inverse of this filter is then applied in the decoder (after delivery of the encoded signal to the decoder).

Typically, the encoder applies the filter in the frequency domain (i.e., to frequency components generated by applying a time domain-to-frequency domain transform on the audio data to be encoded), and the inverse filter is also applied (by the decoder) in the frequency domain (i.e., during or after decoding of frequency-domain encoded audio data, but before application of a frequency domain-to-time domain transform on the decoded audio data.

Herein, we use the term "quantization noise filter" to denote a filter designed to reduce audible noise (e.g., pre-echo noise) due to quantization during encoding of audio data. Herein, it is contemplated that a quantization noise filter may be applied by an encoder (i.e., during encoding of the audio data), or in a decoder (or a post-filtering system coupled and configured to filter the output of a decoder) during or after decoding of encoded audio data.

An example of a quantization noise filter implemented in an encoder (rather than in a decoder) is described in US Patent Application Publication No. 2010/0094637 A1, published Apr. 15, 2010, and assigned to the assignee of the present invention. The named inventor of US Patent Application Publication No. 2010/0094637 A1 is the same individual as the inventor of the present invention.

It is also contemplated herein that a quantization noise filter may be applied partially by an encoder and partially by a decoder (or a post-filtering system coupled and configured to filter the output of a decoder), for example, by applying a first filter stage in the encoder and a second filter stage in the decoder (or post-filtering system) after delivery of the encoded signal to the decoder. Examples of this latter type of quantization noise filter are those applied by the conventional TNS and Gain Control methods mentioned above. This type of conventional quantization noise filtering has limitations and disadvantages, such as the need for the decoder to apply the inverse of the filter stage ("encoder filter") applied by the encoder, which prevents use of a decoder that is not specially configured to apply the inverse of the encoder filter.

The present inventor has recognized that it would be desirable to implement a quantization noise filter in a decoder (or a post-filter coupled to a decoder), so that a decoder (or post-filter) configured to apply the quantization noise filter can perform quantization noise filtering on audio content, and so that a conventional decoder (or a conventional decoder and conventional post-filter coupled thereto) not configured to apply the quantization noise filter can decode (and optionally also perform post-filtering on) audio content without performing quantization noise filtering on the audio content. In the latter case, the conventionally decoded audio content could usefully be rendered (i.e., the resulting sound could have acceptable quality, although the sound quality might suffer from audible noise due to quantization).

BRIEF DESCRIPTION OF THE INVENTION

In a first class of embodiments, the invention is a method including steps of decoding an encoded audio signal indicative of encoded audio content to generate a decoded audio signal indicative of a decoded version of the audio content (e.g., a decoded version of at least one audio channel of an encoded audio program), and performing adaptive quantization noise filtering on the decoded audio signal. It is assumed that the encoding performed to generate the encoded audio content included a quantization step. The quantization noise filtering is performed adaptively in the spectral domain (frequency domain), in response to data indicative of "signal to noise" values which are indicative (e.g., at least approximately indicative) of a post-quantization, signal-to-quantization noise ratio for each frequency band of at least one segment (e.g., each segment) of the encoded audio content. The signal to noise values may be denoted as SQNR[k], with k denoting the frequency band to which each signal to noise value SQNR[k] pertains. In preferred embodiments in the first class, each signal to noise value SQNR[k] is a bit allocation value equal to the number of mantissa bits of at least one encoded audio sample (e.g., each audio sample) of a frequency band of a segment of the encoded audio content. In typical embodiments, the adaptive quantization noise filtering applies relatively less quantization noise filtering to frequency components of decoded audio content (decoded versions of encoded audio samples) in frequency bands having better signal to noise ratio (i.e., post-quantization signal to quantization noise ratio), and relatively more quantization noise filtering to frequency components of the audio content in frequency bands having lower signal to noise ratio.

In some embodiments, the quantization noise filtering is performed adaptively on the decoded audio signal by determining a filter gain value (e.g., one of the $\alpha[k]$ values output from subsystem 23 of below-described FIG. 3) for each frequency band of each segment of the decoded audio signal, and performing the quantization noise filtering to reduce quantization noise in each frequency band of at least one segment to a degree determined by the corresponding filter gain value. In typical ones of such embodiments, each filter gain value is determined from a corresponding signal to noise value, SQNR[k], by mapping the signal to noise value to the filter gain value in accordance with a predetermined non-decreasing function (typically having range from 0 to 1 inclusive) of the signal to noise value. For example, the filter gain value may be proportional to (or it may be another increasing function of) the signal to noise value, SQNR[k]. In some embodiments, the quantization noise filtering is performed adaptively on the decoded audio signal by generating a non-adaptively filtered audio signal indicative of a sequence of non-adaptively filtered values (e.g., the values Y'[k] generated by subsystem 24 of FIG. 3) for each of the frequency bands; and in response to the non-adaptively filtered audio signal and the filter gain values, generating a quantization noise filtered audio signal indicative of a sequence of adaptively quantization noise filtered values (e.g., the values Z[k] output from element 27 of FIG. 3) for each of the frequency bands.

In the first class of embodiments, the method is typically performed by a decoder only (e.g., in a post-filtering subsystem of a decoder) or by a post-filter coupled to receive a decoder's output (indicative of a decoded version of an encoded audio signal).

In typical embodiments, the adaptive quantization noise filtering is designed to reduce audible noise (e.g., pre-echo noise) that would otherwise occur (during rendering and playback of the decoded audio content which undergoes the filtering) as a result of noise introduced to the audio content by quantization during encoding. In such embodiments, because the spectral domain adaptive filtering is applied in a decoder (or a post-filter coupled to receive the output of a decoder), it will suppress both quantization noise and audio content in the time domain (i.e., both quantization noise and audio content indicated by a transformed version of the frequency components of the filtered signal, generated by applying a frequency-to-time domain transform to the frequency components of the filtered signal). In order to mitigate the damage to the original (pre-encoded) audio content caused by the quantization noise filter, the filter is applied adaptively such that spectral bins that have better signal to quantization noise ratio after quantization have relatively less quantization noise filtering applied to them, while spectral bins with poor signal to quantization nose ratio after quantization have relatively more quantization noise filtering applied to them.

Another aspect of the invention is an audio signal processing system (e.g., a decoder or a post-filter coupled to receive the output of a decoder) which is or includes an adaptive quantization noise filter configured to perform any embodiment of the inventive method.

It is contemplated that in some embodiments, the encoded audio signal which is decoded and adaptively filtered in accordance with the invention is indicative of audio captured (e.g., at different endpoints of a teleconferencing system) during a multiparty teleconference. The decoder (or post-filter) which performs the inventive filtering may be implemented at a conferencing system endpoint.

Another aspect of the invention is a method for decoding encoded audio data, including the steps of: decoding a signal indicative of encoded audio data to generate a decoded version of the encoded audio data (e.g., a decoded version of at least one audio channel of an encoded audio program); and performing adaptive quantization noise filtering on the decoded version of the encoded audio data signal in accordance with any embodiment of the inventive adaptive quantization noise filtering method.

Other aspects of the invention include a system or device (e.g., a decoder or a processor) configured (e.g., programmed) to perform any embodiment of the inventive method, and a computer readable medium (e.g., a disc) which stores code for implementing any embodiment of the inventive method or steps thereof. For example, the inventive system can be or include a programmable general purpose processor, digital signal processor, or microprocessor, programmed with software or firmware and/or otherwise configured to perform any of a variety of operations on data, including an embodiment of the inventive method or steps thereof. Such a general purpose processor may be or include a computer system including an input device, a memory, and processing circuitry programmed (and/or otherwise configured) to perform an embodiment of the inventive method (or steps thereof) in response to data asserted thereto.

NOTATION AND NOMENCLATURE

Figure 1:
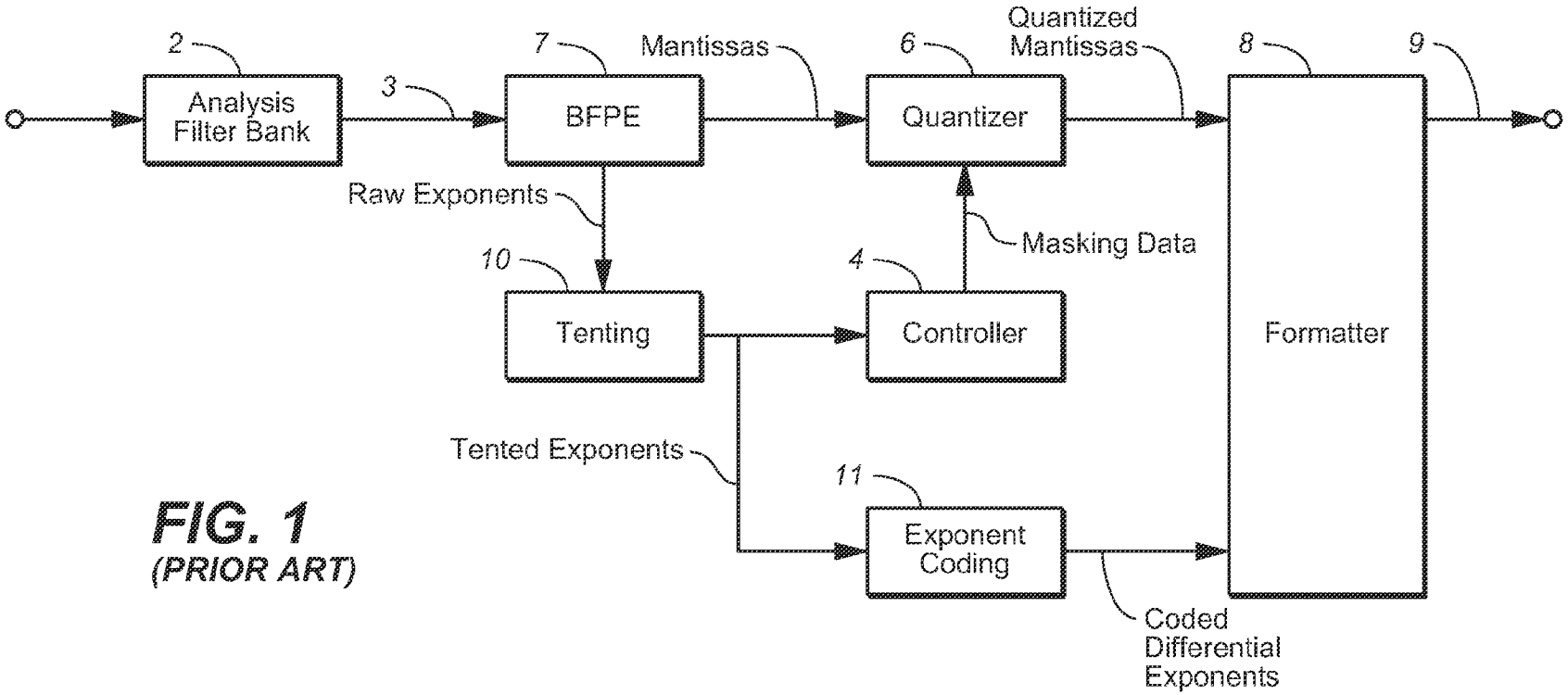
FIG. 1 (PRIOR ART)
FIG. 1 is a block diagram of a conventional encoding system.

Throughout this disclosure, including in the claims, the expression performing an operation "on" a signal or data (e.g., filtering, scaling, transforming, or applying gain to, the signal or data) is used in a broad sense to denote performing the operation directly on the signal or data, or on a processed version of the signal or data (e.g., on a version of the signal that has undergone preliminary filtering or pre-processing prior to performance of the operation thereon).

Throughout this disclosure including in the claims, the expression "system" is used in a broad sense to denote a device, system, or subsystem. For example, a subsystem that implements a decoder may be referred to as a decoder system, and a system including such a subsystem (e.g., a system that generates X output signals in response to multiple inputs, in which the subsystem generates M of the inputs and the other X-M inputs are received from an external source) may also be referred to as a decoder system.

Throughout this disclosure including in the claims, the term "processor" is used in a broad sense to denote a system or device programmable or otherwise configurable (e.g., with software or firmware) to perform operations on data (e.g., audio, or video or other image data). Examples of processors include a field-programmable gate array (or other configurable integrated circuit or chip set), a digital signal processor programmed and/or otherwise configured to perform pipelined processing on audio or other sound data, a programmable general purpose processor or computer, and a programmable microprocessor chip or chip set.

Throughout this disclosure including in the claims, the expressions "audio processor" and "audio processing unit" are used interchangeably, and in a broad sense, to denote a system configured to process audio data. Examples of audio processing units include, but are not limited to encoders (e.g., transcoders), decoders, codecs, pre-processing systems, post-processing systems, and bitstream processing systems (sometimes referred to as bitstream processing tools).

Throughout this disclosure including in the claims, the expression "metadata" refers to separate and different data from corresponding audio data (audio content of a bitstream which also includes metadata). Metadata is associated with audio data, and indicates at least one feature or characteristic of the audio data (e.g., what type(s) of processing have already been performed, or should be performed, on the audio data, or the trajectory of an object indicated by the audio data). The association of the metadata with the audio data is time-synchronous. Thus, present (most recently received or updated) metadata may indicate that the corresponding audio data contemporaneously has an indicated feature and/or comprises the results of an indicated type of audio data processing.

Throughout this disclosure including in the claims, the term "couples" or "coupled" is used to mean either a direct or indirect connection. Thus, if a first device couples to a second device, that connection may be through a direct connection, or through an indirect connection via other devices and connections.

Throughout this disclosure including in the claims, the following expressions have the following definitions:

speaker and loudspeaker are used synonymously to denote any sound-emitting transducer. This definition includes loudspeakers implemented as multiple transducers (e.g., woofer and tweeter);

speaker feed: an audio signal to be applied directly to a loudspeaker, or an audio signal that is to be applied to an amplifier and loudspeaker in series;

channel (or "audio channel"): a monophonic audio signal. Such a signal can typically be rendered in such a way as to be equivalent to application of the signal directly to a loudspeaker at a desired or nominal position. The desired position can be static, as is typically the case with physical loudspeakers, or dynamic;

audio program: a set of one or more audio channels (at least one speaker channel and/or at least one object channel) and optionally also associated metadata (e.g., metadata that describes a desired spatial audio presentation);

speaker channel (or "speaker-feed channel"): an audio channel that is associated with a named loudspeaker (at a desired or nominal position), or with a named speaker zone within a defined speaker configuration. A speaker channel is rendered in such a way as to be equivalent to application of the audio signal directly to the named loudspeaker (at the desired or nominal position) or to a speaker in the named speaker zone;

object channel: an audio channel indicative of sound emitted by an audio source (sometimes referred to as an audio "object"). Typically, an object channel determines a parametric audio source description (e.g., metadata indicative of the parametric audio source description is included in or provided with the object channel). The source description may determine sound emitted by the source (as a function of time), the apparent position (e.g., 3D spatial coordinates) of the source as a function of time, and optionally at least one additional parameter (e.g., apparent source size or width) characterizing the source; and render: the process of converting an audio program into one or more speaker feeds, or the process of converting an audio program into one or more speaker feeds and converting the speaker feed(s) to sound using one or more loudspeakers. An audio channel can be trivially rendered ("at" a desired position) by applying the signal directly to a physical loudspeaker at the desired position, or one or more audio channels can be rendered using one of a variety of virtualization techniques designed to be substantially equivalent (for the listener) to such trivial rendering. In this latter case, each audio channel may be converted to one or more speaker feeds to be applied to loudspeaker(s) in known locations, which are in general different from the desired position, such that sound emitted by the loudspeaker(s) in response to the feed(s) will be perceived as emitting from the desired position. Examples of such virtualization techniques include binaural rendering via headphones (e.g., using Dolby Headphone processing which simulates up to 7.1 channels of surround sound for the headphone wearer) and wave field synthesis.

DETAILED DESCRIPTION OF EMBODIMENTS OF THE INVENTION

Embodiments of systems configured to implement the inventive method will be described with reference to FIGS. 2, 3, 4, and 9.

Figure 3:
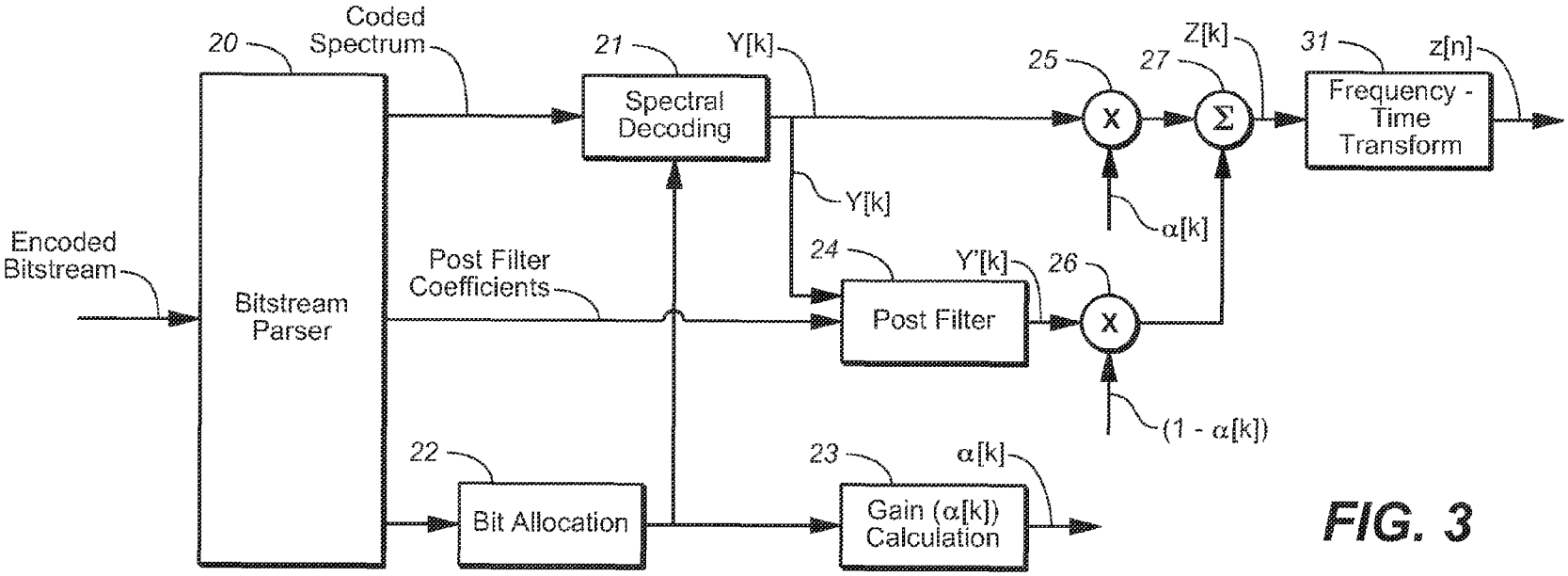
FIG. 3 is a block diagram of a decoding system configured to perform an embodiment of the inventive method.

FIG. 3 is a block diagram of an embodiment of the inventive decoder (decoding system) comprising elements 20, 21, 22, 23, 24, 25, 26, 27, and 31, coupled as shown. The FIG. 3 decoder includes an adaptive post-filtering subsystem (sometimes referred to herein as an adaptive post-filter) comprising elements 23, 24, 25, 26, and 27. In some implementations, the FIG. 3 decoder may include additional elements which are not shown in FIG. 3 for simplicity.

The adaptive post-filter of FIG. 3 (and thus the FIG. 3 decoder) is configured to perform adaptive quantization noise filtering in accordance with an embodiment of the inventive method including by employing elements 23, 25, 26, and 27 to adaptively apply a non-adaptive post-filter (implemented and applied by subsystem 24) to decoded audio data in response to bit allocation values. The decoded audio data are decoded frequency components Y[k], generated in decoding subsystem 21, where the index k identifies the frequency band corresponding to each decoded frequency component.

In response to the bit allocation values (each indicative of the number of mantissa bits of at least one of the decoded frequency components Y[k], and thus indicative of (and corresponds to) a signal to quantization noise ratio, SQNR [k], for each corresponding decoded frequency component Y[k]), gain calculation subsystem 23 is configured to determine a quantization noise filter gain value, $\alpha[k]$, for each decoded frequency component, Y[k]. The adaptive quantization noise filter gain values $\alpha[k]$ determine a degree of quantization gain filtering to be applied to each decoded frequency component, Y[k].

Parsing subsystem 20 of the FIG. 3 decoder is coupled and configured to receive and parse an encoded bitstream (an encoded audio signal) which has been delivered to the decoder (e.g., by delivery subsystem 91 of FIG. 2) and which is indicative of an encoded audio program. The program's audio content is indicated by frequency domain audio data (i.e., a sequence of frequency components) of the bitstream.

Parsing subsystem 20 is coupled and configured to parse from the delivered bitstream the audio data indicative of the program's audio content (and typically also metadata corresponding to the audio data) and to assert the audio data (and typically also the metadata) to decoding subsystem 21. Parsing subsystem 20 is also coupled and configured to parse from the delivered bitstream the coefficients of the non-adaptive post-filter to be applied to a decoded version of the audio data (by subsystem 24) and to assert these filter coefficients to subsystem 24. The non-adaptive post-filter coefficients asserted to subsystem 24 may be the coefficients "b[j]" of equation (1) below (in the case that the non-adaptive post-filter is a finite impulse response (FIR) filter, so that the coefficients "a[j]" of equation (1) are all equal to zero), or they may be the coefficients "a[j]" and "b[j]" of equation (1) in the case that the non-adaptive post-filter is an infinite impulse response (IIR) filter.

In some embodiments, the delivered bitstream does not include the bit allocation values employed by filter gain calculation subsystem 23 (each indicative of the number of mantissa bits of at least one corresponding encoded audio data sample) to generate the adaptive quantization noise filter gain values, $\alpha[k]$. In these embodiments, bit allocation subsystem 22 is coupled and configured to generate the bit allocation values (each of which may be the number of mantissa bits of a corresponding frequency domain audio sample in each of at least one of the frequency bands) from the bitstream's encoded audio data. In these embodiments, the bitstream's encoded audio data (or the encoded mantissas thereof) are asserted to subsystem 22 from subsystem 20, and subsystem 22 is configured to generate the bit allocation values in response thereto and to assert the generated bit allocation values to decoding subsystem 21 and filter gain calculation subsystem 23.

Figure 4:
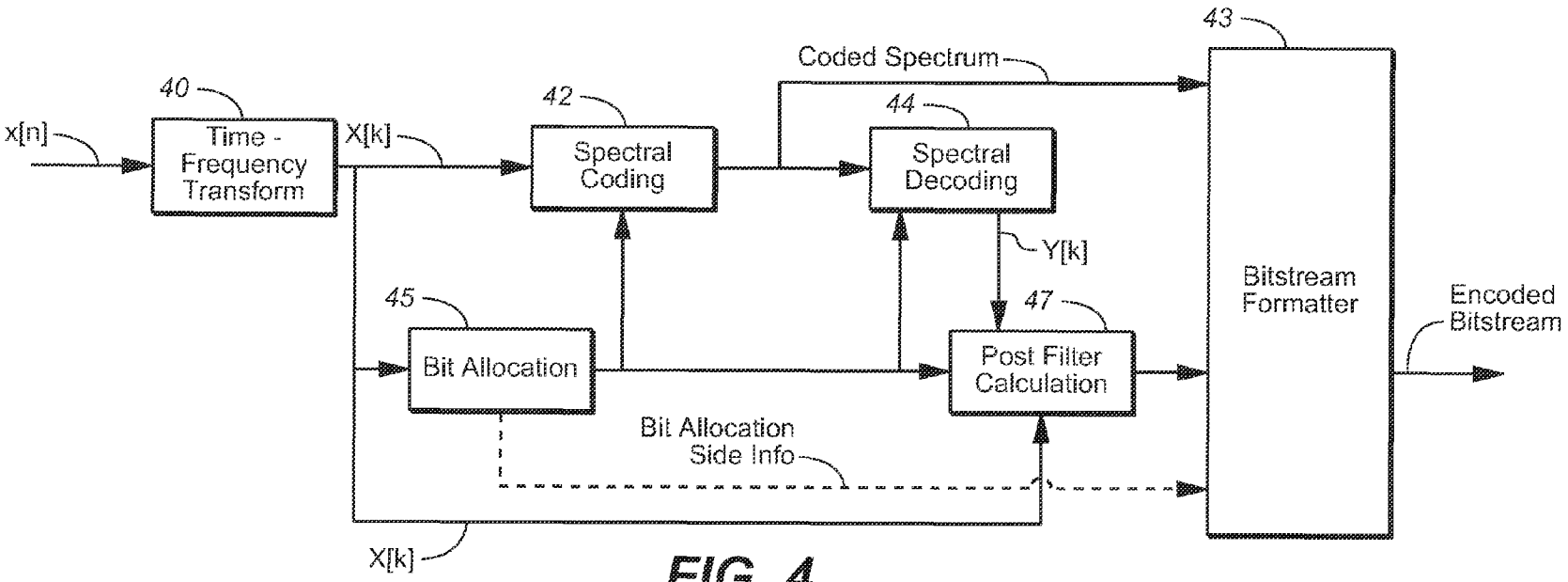
FIG. 4 is a block diagram of an encoding system configured to generate an encoded audio program, and post-filter coefficients useful to perform an embodiment of the inventive method on audio content of a decoded version of the encoded audio program.

In some implementations of the FIG. 3 decoder, the bitstream parsed by subsystem 20 has AC-3 or E-AC-3 format (e.g., it may have been generated by an implementation of the FIG. 4 encoder configured to generate a bitstream having AC-3 or E-AC-3 format). In other implementations of the FIG. 3 decoder, the bitstream parsed by subsystem 20 has another format.

In implementations of the FIG. 3 decoder in which the bitstream parsed by subsystem 20 has AC-3 or E-AC-3 format, the encoded audio data input to bit allocation subsystem 22 is indicative of a sequence of exponent values and a sequence of N quantized mantissa values (one for each of N consecutive frequency bins) which share the same exponent value in the sequence of exponent values. The value of N (e.g., N=1, N=2, or N=4) is determined by metadata of the bitstream (also asserted to subsystem 22). Each such set of N consecutive bins is a frequency band (comprising N consecutive bins). Subsystem 22 is configured to generate a sequence of bit allocation values for each such frequency band (i.e., one bit allocation value for each frequency band, for each segment of the bitstream). Each bit allocation value is indicative of the number of bits of each of the mantissas of the corresponding band, in the relevant segment of the bitstream.

Alternatively, the bitstream delivered to parsing subsystem 20 includes the bit allocation values (i.e., they are included as metadata indicative of the number of mantissa bits of corresponding audio data) required by filter gain calculation subsystem 23 (or by decoding subsystem 21 and filter gain calculation subsystem 23). In such alternative embodiments, bit allocation subsystem 22 is typically omitted, and parsing subsystem 20 is coupled and configured to parse the bit allocation values from the delivered bitstream and to assert the bit allocation values directly to subsystems 21 and 23.

Decoding subsystem 21 is configured to decode the encoded, frequency domain audio data of the bitstream. In typical implementations, the decoding includes steps of performing on the encoded audio data the inverse of each encoding operation (e.g., entropy coding and quantization) that had been performed (in an encoder) to generate the encoded audio data, typically using the above-mentioned bit allocation values. As a result, subsystem 21 generates (and asserts to multiplication element 25) a decoded audio signal. The decoded audio signal is indicative of a sequence of decoded frequency components Y[k], where the index k identifies the frequency band corresponding to each component Y[k], and thus the decoded audio signal will sometimes be referred to simply as the decoded frequency components Y[k].

The subsystem comprising elements 23, 24, 25, 26, and 27 (connected as shown, and which implement an embodiment of the inventive quantization noise filter) is configured to perform adaptive post-filtering on the decoded frequency components Y[k], sometimes referred to herein as the decoded spectrum, to generate:

a non-adaptively filtered audio signal indicative of a sequence of non-adaptively filtered values, Y'[k] (given by equation (1) below), for each of the frequency bands. The non-adaptively filtered signal is asserted at the output of subsystem 24; and a quantization noise filtered audio signal indicative of a sequence of adaptively quantization noise filtered values, Z[k] (given by equation (2) below), for each of the frequency bands. The quantization noise filtered signal is asserted at the output of multiplication element 27.

Transform subsystem 31 is coupled and configured to perform a frequency-to-time domain transformation on the quantization noise filtered signal to generate a time-domain quantization noise filtered signal indicative of a sequence of audio samples z[n].

As noted, the non-adaptive post-filter applied by non-adaptive post-filter subsystem 24 to the decoded frequency components, Y[k], is typically determined by filter coefficients which are generated in the encoder, included in the bitstream delivered to the decoder, and parsed from the bitstream (and asserted to subsystem 24) by subsystem 20 of the decoder. In a typical class of implementations, the non-adaptive filter coefficients are the "a[j]" and "b[j]" coefficients of the following equation ("equation (1)"), and subsystem 24 applies the non-adaptive post-filter to generate the non-adaptively filtered components Y'[k] of the non-adaptively filtered signal such that they satisfy equation (1):

$$Y'[k] = \sum_{j=0}^{M-1} a[j]Y[k-j] + \sum_{j=1}^{O-1} b[j]Y[k-j] \tag{1}$$

In equation (1), "M" and "0" denote feedback filter order and feedforward filter order.

In the case that the non-adaptive post-filter is a finite impulse response (FIR) filter, so that the "a[j]" coefficients of equation (1) are all equal to zero, the non-adaptive post-filter coefficients asserted (from subsystem 20) to subsystem 24 consist only of the "b[j]" coefficients of equation (1). In the case that the non-adaptive post-filter is an infinite impulse response (IIR) filter, the non-adaptive post-filter coefficients asserted (from subsystem 20) to subsystem 24 may be the "a[j]" and "b[j]" coefficients of equation (1).

Elements 23, 26, 25, and 27 are configured to generate the final (adaptively quantization noise filtered) spectrum Z[k] for each time segment of the bitstream as an adaptively varied linear combination of the non-filtered decoded spectrum Y[k] and the non-adaptively post-filtered spectrum Y'[k] for the time segment, for all the frequency bands k. Each combination of a value (Y'[k]) of the non-adaptively filtered decoded signal, and the corresponding value (Y[k]) of the non-filtered decoded signal, is adaptively controlled by a corresponding one of the quantization noise filter gain values, α[k], which is in turn determined by a corresponding one of the above-mentioned bit allocation values. Frequency bands with coarse quantization (poor signal to quantization noise ratio) will have α[k] close to 0, while frequency bands with finer quantization (better signal to quantization noise ratio) will have α[k] close to 1.

In a typical implementation, the quantization noise filtered signal Z[k] (for each segment of the decoded audio content) is generated from the non-filtered, decoded signal Y[k] (output from subsystem 21 for the same segment of the decoded audio content), and the non-adaptively post-filtered version Y'[k] of the signal Y[k] (output from subsystem 24 for the same segment of the decoded audio content), as follows:

$$Z[k]=\alpha[k]Y[k]+(1-\alpha[k])Y'[k] \tag{2}$$

where the value α[k], for each frequency band k of each time segment of the bitstream, is the adaptive quantization noise filter gain value for the decoded frequency component, Y[k], for the same band k and the same time segment of the bitstream.

With reference to FIG. 3, multiplication element 25 multiplies each decoded frequency component, Y[k], by the corresponding value α[k], multiplication element 26 multiplies each non-adaptively filter decoded frequency component, Y'[k], by the corresponding value (1−α[k]), and addition element 27 adds each value α[k]Y[k] (output from element 25) to the corresponding value (1−α[k])Y' [k] (output from element 26).

Typically, subsystem 23 is configured to determine the quantization noise filter gain value α[k] for each decoded frequency component Y[k] from the corresponding bit allocation value (i.e., the bit allocation value for the same frequency band, k, and segment of the bitstream), by mapping the bit allocation value to the filter gain value in accordance with a predetermined non-decreasing function (typically having range from 0 to 1 inclusive) of the bit allocation value. Each of the bit allocation values is indicative of the number of mantissa bits of each of the decoded frequency components Y[k], in the relevant frequency band k and time segment of the bitstream, and thus is indicative of (and corresponds to) a signal to quantization noise ratio, SQNR[k], for each corresponding decoded frequency component Y[k].

Each of the adaptive quantization noise filter gain values, α[k], determines a degree of quantization gain filtering applied to each decoded frequency component, Y[k], as indicated in equation (2). For example, when α[k]=0 (which occurs when the signal to quantization noise ratio, SQNR[k], has its lowest value, indicating coarse quantization in the encoder), the value Z[k]=Y'[k] is output from element 27 so that full quantization gain filtering is applied to each corresponding decoded frequency component, Y[k]. For another example, when α[k]=1 (which occurs when the signal to quantization noise ratio, SQNR[k], has its highest value, indicating fine quantization in the encoder), the value Z[k] =Y[k] is output from element 27 so that no quantization gain filtering is applied to each corresponding decoded frequency component, Y[k].

As noted, the decoder of FIG. 3 implements the adaptive quantization noise filter of equation (2). Other embodiments of the inventive decoder (and adaptive post-filter) implement other adaptive quantization noise filters, e.g., other adaptively varied linear combinations of a non-filtered decoded spectrum Y[k], and a non-adaptively post-filtered version Y'[k] of the spectrum Y[k] (where the non-adaptive post-filter is typically determined by non-adaptive quantization noise filter coefficients delivered with the encoded audio signal), for all frequency bands k and each time segment of the encoded audio signal.

FIG. 4 is a block diagram of an encoding system configured to generate an encoded audio program, and to generate post-filter coefficients useful to a decoder (e.g., the decoder of FIG. 3) in performing an embodiment of the inventive method on audio content of a decoded version of the encoded audio program. The FIG. 4 encoder comprises transform subsystem 40, coding subsystem 42, bit allocation subsystem 45, decoding subsystem 44, post-filter coefficient calculation subsystem 47, and bitstream formatting subsystem ("formatter") 43, coupled as shown. In some implementations, the FIG. 4 encoder may include additional elements which are not shown in FIG. 4 for simplicity.

As shown in FIG. 4, an input audio signal comprising a sequence of audio samples, x(n), undergoes a time domain-to-frequency domain transform in transform subsystem 40 to generate a sequence of frequency components X[k], where k here denotes frequency bin. The frequency components X[k] are encoded in coding subsystem 42, including by quantization based on a bit allocation (typically derived from a psychoacoustic model). The resulting encoded frequency components are asserted to formatter 43. Formatter 43 is configured to generate an encoded bitstream in response to the encoded frequency components (typically including quantized mantissa values and encoded differential exponent values) data output from subsystem 42, the metadata (post-filter coefficients) output of subsystem 47, and typically other metadata (which may be generated by other subsystems of the encoder which are not shown in FIG. 4). The encoded bitstream which is output from formatter 43 is indicative of the encoded frequency components, the post-filter coefficients output from subsystem 47, and typically also additional metadata corresponding to the encoded frequency components (and optionally also bit allocation values output from subsystem 45).

Bit allocation subsystem 45 is coupled and configured to generate bit allocation values for use by coding subsystem 42 in response to the frequency components X[k]. In a typical implementation, each of the bit allocation values is the number of mantissa bits of a corresponding one of the components (frequency domain audio samples), X[k]. Subsystem 45 is coupled and configured to assert the generated bit allocation values to coding subsystem 42, decoding subsystem 44, and filter coefficient calculation subsystem 47.

In typical implementations, the encoding operations performed by coding subsystem 42 include entropy coding and quantization of the frequency domain audio samples. The quantization typically quantizes a mantissa value of each audio sample to a number of bits determined by a corresponding one of the bit allocation values from subsystem 45.

In some implementations of the FIG. 4 encoder, the bitstream generated by formatter 43 has AC-3 or E-AC-3 format. In other implementations of the FIG. 4 encoder, the bitstream output from formatter 43 has another format. In implementations in which the bitstream output from formatter 43 has AC-3 or E-AC-3 format (and in some other implementations), each frequency domain audio sample generated by transform stage 40 is converted (e.g., in a stage of subsystem 40) into a floating point format comprising an exponent and a mantissa. In such implementations, the encoded frequency domain audio data output from subsystem 42 may be indicative of a sequence of exponent values and a sequence of N quantized mantissa values (one for each of N consecutive frequency bins) which share the same exponent value in the sequence of exponent values. The value of N (e.g., N=1, N=2, or N=4) is included by formatter 43 as metadata in the encoded bitstream. Each such set of N consecutive bins is a frequency band (comprising N consecutive bins). Subsystem 45 may be configured to generate a sequence of bit allocation values for each such frequency band rather than for each frequency bin (i.e., one bit allocation value for each frequency band, for each segment of the bitstream).

The encoded audio data output from subsystem 42 are decoded in decoding subsystem 44 (in the same manner as they would be decoded by decoding subsystem 21 of the FIG. 3 decoder) and the resulting decoded frequency components, Y[k], are asserted to post-filter calculation subsystem 47 along with the original frequency components X[k] output from subsystem 40 and the bit allocation values output from subsystem 45. In response, subsystem 47 generates non-adaptive quantization noise filter coefficients for the frequency bands of the encoded audio data. In typical implementations, these non-adaptive quantization noise filter coefficients are the "b[j]" coefficients of above-described equation (1) (in the case that the non-adaptive post-filter is an FIR filter), or they are the "a[j]" and "b[j]" coefficients of equation (1) in the case that the non-adaptive post-filter is an IIR filter. In such typical implementations, the non-adaptive post-filter coefficients are included (by formatter 43 in the encoded bitstream output from the FIG. 4 encoder. The encoded bitstream may then be delivered to a decoder, and the non-adaptive post-filter coefficients may then be parsed from the encoded bitstream (e.g., by subsystem 20 of the FIG. 3 decoder) and employed to implement a non-adaptive quantization noise filter (e.g., the filter applied by subsystem 24 of the FIG. 3 decoder) which is adaptively applied (e.g., by elements 23, 24, 25, 26, and 27 of the FIG. 3 decoder) in accordance with an embodiment of the present invention.

In some implementations of the FIG. 4 encoder, formatter 43 does not include the bit allocation values (generated by subsystem 45) in the encoded bitstream output from the encoder.

Figure 5:
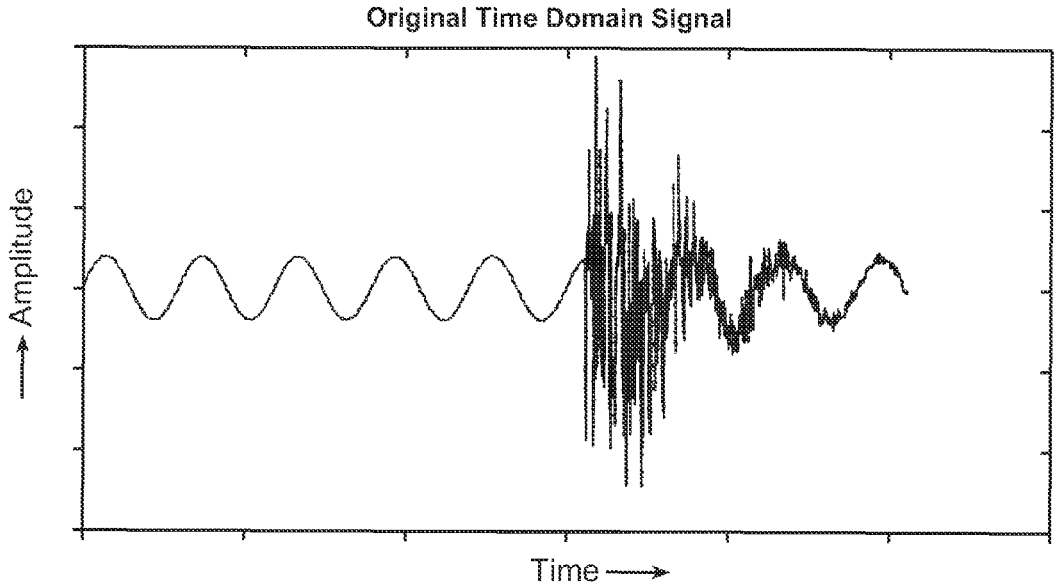
FIG. 5 is the waveform of a time domain signal, comprising a tone (the sinusoidal segments of the waveform) and a sudden transient (between the sinusoidal segments).
Figure 6:
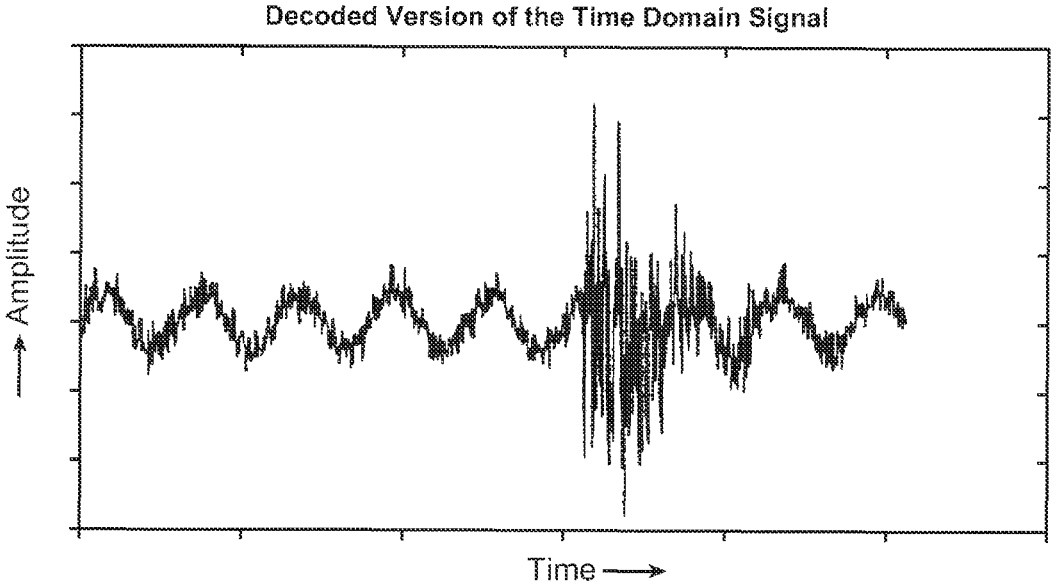
FIG. 6 is the waveform of a time domain signal which is a decoded version of an encoded version of the FIG. 5 signal.

An example of application of the inventive adaptive post-filter will be described with reference to FIGS. 5-8. FIG. 5 is the waveform of the original time domain signal, comprising a tone (the sinusoidal segments of the waveform) and a sudden transient (between the sinusoidal segments). FIG. 6 is the waveform of a time domain signal which is a decoded version of an encoded version of the FIG. 5 signal (where the encoded version was generated by an encoding process including a step of quantization in the spectral domain). As expected, the quantization noise spreads across the entire time sequence leading to pre-echo (which may be audible when the signal is rendered).

Figure 7:
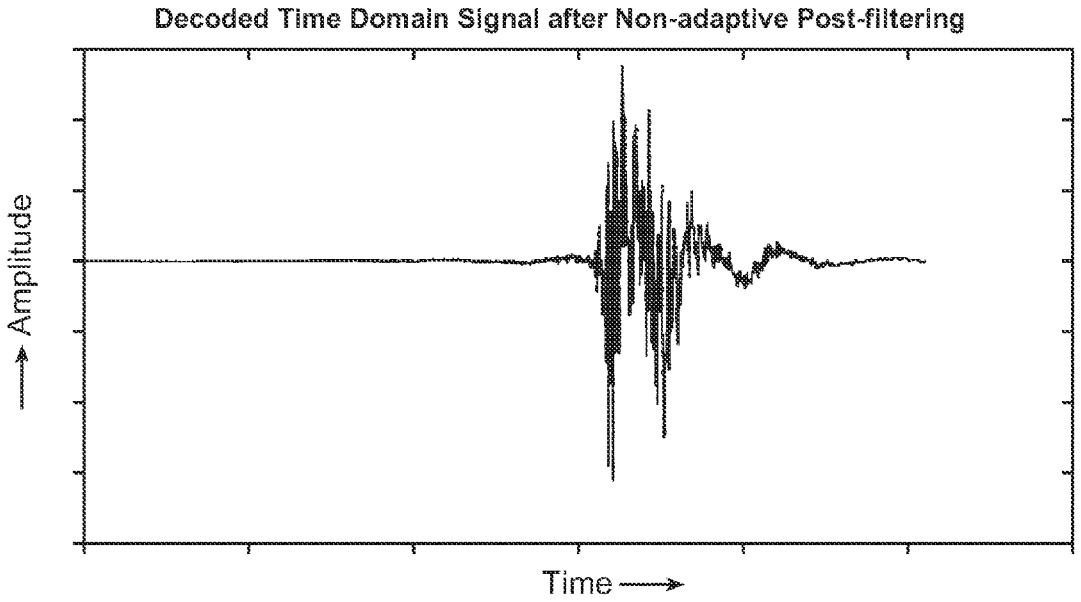
FIG. 7 is the waveform of a time domain signal which is a non-adaptively post-filtered version of the FIG. 6 signal

FIG. 7 is the waveform of a time domain signal which is a non-adaptively post-filtered version of the FIG. 6 signal (i.e., a signal generated by performing all steps performed to generate the FIG. 6 signal other than the final frequency domain-to-time domain transform, and then performing a step of non-adaptive post-filtering in the frequency domain, and finally performing a frequency domain-to-time domain transform on the post-filtered signal). For example, the non-adaptive post-filtering may be of the type performed by subsystem 24 of the FIG. 3 decoder. As is apparent from FIG. 7, the non-adaptive post-filtering undesirably suppresses the tonal segments (the sinusoidal and approximately sinusoidal segments before and after the transient) of the original signal as well as the quantization noise.

Figure 8:
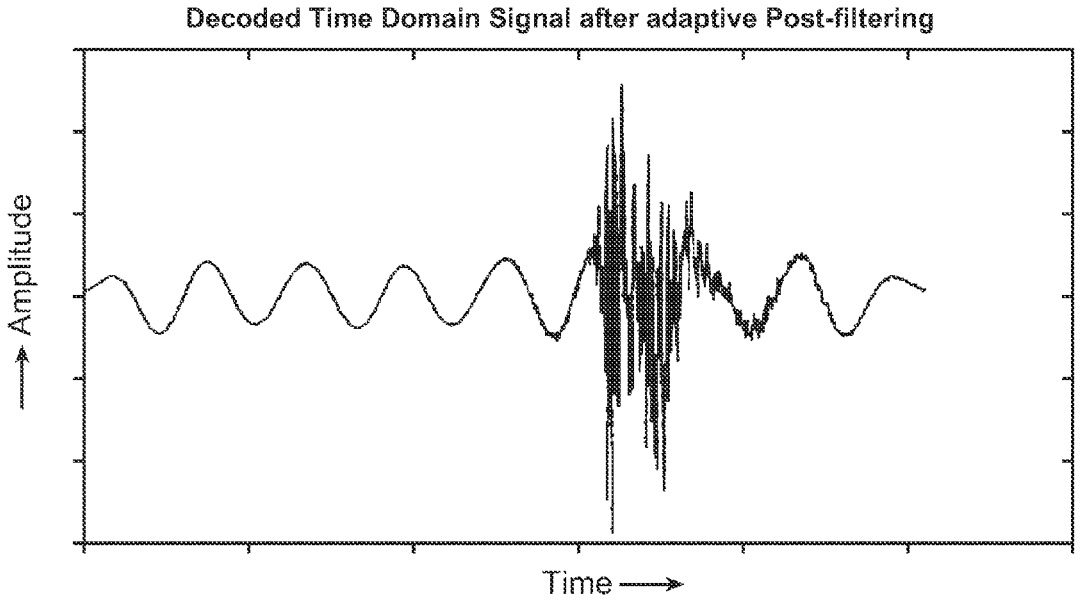
FIG. 8 is the waveform of a time domain signal which is an adaptively post-filtered version of the FIG. 6 signal, generated in accordance with an embodiment of the invention.

FIG. 8 is the waveform of a time domain signal which is an adaptively post-filtered version of the FIG. 6 signal (i.e., a signal generated by performing all steps performed to generate the FIG. 6 signal other than the final frequency domain-to-time domain transform, and then performing a step of adaptive post-filtering in the frequency domain in accordance with an embodiment of the invention, and finally performing a frequency domain-to-time domain transform on the post-filtered signal). For example, the adaptive post-filtering may be of the type performed by subsystems 23, 24, 25, 26, and 27 of the FIG. 3 decoder. As is apparent from FIG. 8, the adaptive post-filtering desirably suppresses the quantization noise but not the tonal segments of the original signal (while also reducing the quantization noise present in the tonal segments of the FIG. 6 signal).

The waveforms plotted in FIGS. 6-8 were generated using a discrete cosine transform (DCT) rather than a modified discrete cosine transform (MDCT) prior to encoding and decoding and post-filtering, followed by the inverse of the DCT (after the post-filtering).

We next describe an example of a method for determining the non-adaptive post-filter (e.g., the filter applied by subsystem 24 of the FIG. 3 decoder, or the filter whose coefficients are generated by subsystem 47 of the FIG. 4 encoder) which is adaptively applied in accordance with the invention. In this example method, the non-adaptive post-filter is a Weiner filter (an FIR filter), and the method determines the filter's coefficients to be the "b[j]" coefficients of above-described equation (1). The example method minimizes the mean squared error between the quantized spectrum Y[k] through an FIR filter and the original spectrum X[k], to determine the filter coefficients "b[j]" to be those which satisfy the following expression:

$$\min_{b[j]} E\left\{\left(X[k] - \sum_{j=0}^{M-1} b[j]Y[k-i]\right)^2\right\}.$$

The solution to the above expression are the filter coefficients "b[j]" which satisfy the following equation (3), which is a normal equation:

$$\begin{bmatrix} b[0] \\ \vdots \\ b[M-1] \end{bmatrix} = inv\left(\begin{bmatrix} R_{YY}[0] & \dots & R_{YY}[M\ \ 1] \\ \vdots & \ddots & \vdots \\ R_{YY}[M-1] & \dots & R_{YY}[0] \end{bmatrix}\right) \cdot \begin{bmatrix} R_{XY}[0] \\ \vdots \\ R_{XY}[M-1] \end{bmatrix} \quad (3)$$

As apparent from equation (3), to determine the non-adaptive filter coefficients "b[j]" which satisfy equation (3), the inverse of the autocorrelation matrix of the quantized spectrum Y[k] is multiplied by the cross correlation matrix between the original spectrum X[k] and the quantized spectrum Y[k]. In order to account for the adaptive application of the non-adaptive filter in accordance with the invention, the autocorrelation and cross correlation matrices in equation (3) are weighted as shown in equations (4) and (5) respectively:

$$R_{YY}[j] = \sum_{k=0}^{N-j-1} w[k]Y[k] \cdot w[k-j]Y[k-j] \quad (4)$$

and $$R_{XY}[j] = \sum_{k=0}^{N-j-1} w[k]X[k] \cdot w[k-j]Y[k-j] \quad (5)$$

It should be noted that equations (4) and (5) assume real signals.

In equations (4) and (5), the weighting value w[k] for each frequency band k is chosen as follows when the adaptive application of the non-adaptive filter in accordance with the invention is performed as described above with reference to equation (2), so that the quantization noise filtered signal Z[k] (for each segment of the decoded audio content) is generated from the non-filtered, decoded signal Y[k] (for the same segment of the decoded audio content), and the non-adaptively post-filtered version F[k] of the signal Y[k] (for the same segment of the decoded audio content) as: Z[k] = a[k] Y[k] +(1−α[k]) Y'[k] , where the value a[k], for each frequency band k of each time segment of the bitstream, is an adaptive quantization noise filter gain value for the decoded frequency component, Y[k], for the same band k and the same time segment of the bitstream. In this case:

each filter gain value a[k] is determined from a corresponding signal to quantization noise value, SQNR[k], for the same band, by mapping the signal to quantization noise value to the filter gain value in accordance with a predetermined non-decreasing function (typically having range from 0 to 1 inclusive) of the signal to quantization noise value; and the weighting value w[k] for the band k is determined by mapping the quantization noise value, SQNR[k], for the band to the weighting value w[k] in accordance with the inverse of the predetermined non-decreasing function noted in the previous paragraph.

For example, if each filter gain value α[k] is proportional to the corresponding signal to quantization noise value SQNR[k], then the corresponding weighting value w[k] may be the inverse of the corresponding filter gain value α[k], so that w[k]·α[k] =1. Thus, relatively lower values of SQNR[k] correspond to relatively lower bit allocation values (relatively smaller numbers of mantissa bits per sample), relatively lower filter gain values α[k], and relatively larger values of w[k].

As noted above, when bit allocation values (e.g., those output from subsystem 45 of the FIG. 4 encoder to non-adaptive filter coefficient calculation subsystem 47 of the encoder) are each indicative of the number of mantissa bits of a corresponding one of the decoded frequency components Y[k], each of the bit allocation values corresponds to a signal to quantization noise ratio, SQNR[k], for a corresponding decoded frequency component Y[k]. Thus, a typical implementation of subsystem 47 of the FIG. 4 encoder is configured to determine the weighting values w[k] of equations (4) and (5) from the bit allocation values output from subsystem 45, and then determines the non-adaptive filter coefficients b[j] in accordance with equation (3), with the autocorrelation and cross correlation matrices in equation (3) weighted as shown in equations (4) and (5) with the weighting values w[k].

Another aspect of the invention is a system including a decoder (or post-filter) configured to perform any embodiment of the inventive method on a decoded version of encoded audio data, and an encoder configured to generate the encoded audio data. The FIG. 2 system and the FIG. 9 system are examples of such a system.

Figure 2:
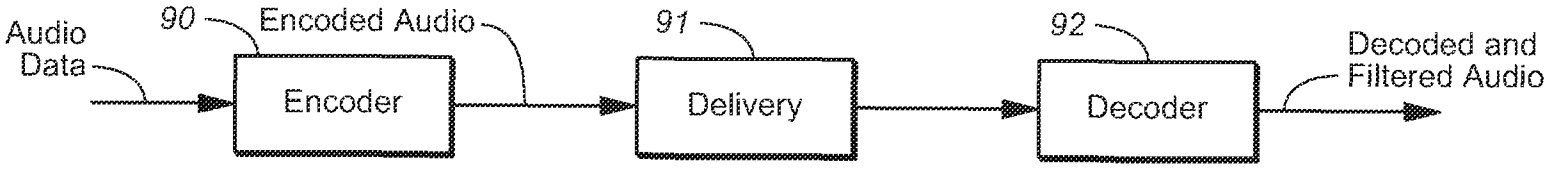
FIG. 2 is a block diagram of a system including an encoder configured to generate encoded audio data in response to audio data, and a decoder configured to decode the encoded audio data (including by performing any embodiment of the inventive filtering method) to generate a recovered and filtered version of the audio data.

The system of FIG. 2 includes encoder 90, which is configured (e.g., programmed) to generate encoded audio data (an encoded audio bitstream) in response to audio data, delivery subsystem 91, and decoder 92. Delivery subsystem 91 is coupled and configured to store the encoded audio data generated by encoder 90 and/or to transmit an encoded audio signal indicative of the encoded audio data. Decoder 92 is coupled and configured (e.g., programmed) to receive the encoded audio data from subsystem 91 (e.g., by reading or retrieving the encoded audio data from storage in subsystem 91, or receiving a signal indicative of the encoded audio data that has been transmitted by subsystem 91), to decode the encoded audio data to generate a decoded version of the encoded audio data, and to perform any embodiment of the inventive adaptive quantization noise filtering method on the decoded version of the encoded audio data (and typically also to generate an output a signal indicative of the adaptively filtered, decoded version of the encoded audio data).

Figure 9:
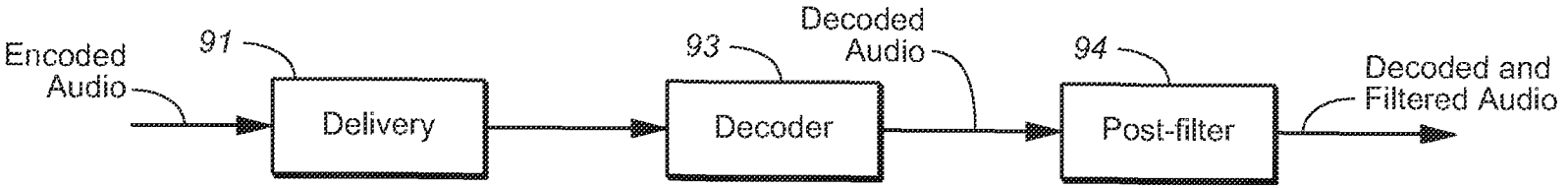
FIG. 9 is a block diagram of a system including a decoder configured to decode an audio signal indicative of encoded audio data to generate a decoded version of the encoded audio data, and a post-filter coupled to receive the decoder's output and configured to perform thereon any embodiment of the inventive filtering method generate a recovered and filtered version of the audio data.

The system of FIG. 9 includes delivery subsystem 91 (identical to subsystem 91 of FIG. 2), which is coupled and configured to store encoded audio data (of the same type generated by encoder 90 of FIG. 2) and/or to transmit an encoded audio signal indicative of such encoded audio data. Decoder 93 is coupled and configured (e.g., programmed) to receive the encoded audio data from subsystem 91 (e.g., by reading or retrieving the encoded audio data from storage in subsystem 91, or receiving a signal indicative of the encoded audio data that has been transmitted by subsystem 91), and to decode the encoded audio data to generate a decoded version of the encoded audio data. Post-filter 94 is coupled to receive the output of decoder 93 (i.e., the decoded version of the encoded audio data, and typically also metadata including signal to noise values and optionally also non-adaptive filter coefficients delivered by subsystem 91 to decoder 93 with the encoded audio data), and configured to perform any embodiment of the inventive adaptive quantization noise filtering method on the decoded version of the encoded audio data, and to generate an output a signal indicative of the resulting adaptively filtered, decoded version of the encoded audio data.

Another aspect of the invention is a method (e.g., a method performed by decoder 92 of FIG. 2) for decoding encoded audio data, including the steps of: decoding a signal indicative of encoded audio data to generate a decoded version of the encoded audio data (e.g., a decoded version of at least one audio channel of an encoded audio program); and performing adaptive quantization noise filtering on the decoded version of the encoded audio data signal in accordance with any embodiment of the inventive adaptive quantization noise filtering method.

The invention may be implemented in hardware, firmware, or software, or a combination of both (e.g., as a programmable logic array). Unless otherwise specified, the algorithms or processes included as part of the invention are not inherently related to any particular computer or other apparatus. In particular, various general-purpose machines may be used with programs written in accordance with the teachings herein, or it may be more convenient to construct more specialized apparatus (e.g., integrated circuits) to perform the required method steps. Thus, the invention may be implemented in one or more computer programs executing on one or more programmable computer systems (e.g., a computer system which implements the decoder of FIG. 3), each comprising at least one processor, at least one data storage system (including volatile and non-volatile memory and/or storage elements), at least one input device or port, and at least one output device or port. Program code is applied to input data to perform the functions described herein and generate output information. The output information is applied to one or more output devices, in known fashion.

Each such program may be implemented in any desired computer language (including machine, assembly, or high level procedural, logical, or object oriented programming languages) to communicate with a computer system. In any case, the language may be a compiled or interpreted language.

For example, when implemented by computer software instruction sequences, various functions and steps of embodiments of the invention may be implemented by multithreaded software instruction sequences running in suitable digital signal processing hardware, in which case the various devices, steps, and functions of the embodiments may correspond to portions of the software instructions.

Each such computer program is preferably stored on or downloaded to a storage media or device (e.g., solid state memory or media, or magnetic or optical media) readable by a general or special purpose programmable computer, for configuring and operating the computer when the storage media or device is read by the computer system to perform the procedures described herein. The inventive system may also be implemented as a computer-readable storage medium, configured with (i.e., storing) a computer program, where the storage medium so configured causes a computer system to operate in a specific and predefined manner to perform the functions described herein.

A number of embodiments of the invention have been described. Nevertheless, it will be understood that various modifications may be made without departing from the spirit and scope of the invention. Numerous modifications and variations of the present invention are possible in light of the above teachings. It is to be understood that within the scope of the appended claims, the invention may be practiced otherwise than as specifically described herein.

What is claimed is:

1. A method, including the steps of:

(a) decoding an encoded audio signal indicative of encoded audio content to generate a decoded audio signal indicative of a decoded version of the audio content; and (b) performing adaptive quantization noise filtering on the decoded audio signal in response to data indicative of signal to noise values, where the signal to noise values are indicative of a post-quantization, signal-to-quantization noise ratio for each frequency band of at least one segment of the encoded audio content, wherein adaptive quantization noise filtering is or includes generation of a quantization noise filtered signal indicative of a sequence of adaptively quantization noise filtered values for each said segment, where the sequence of adaptively quantization noise filtered values is an adaptively varied linear combination of non-filtered frequency components of the decoded audio signal and non-adaptively post-filtered frequency components of the decoded audio signal.

2. A method, including the steps of:

(a) decoding an encoded audio signal indicative of encoded audio content to generate a decoded audio signal indicative of a decoded version of the audio content and (b) performing adaptive quantization noise filtering on the decoded audio signal in response to data indicative of signal to noise values, where the signal to noise values are indicative of a post-quantization, signal-to-quantization noise ratio for each frequency band of at least one segment of the encoded audio content, wherein step (b) includes a step of:

determining filter gain values in response to the signal to noise values, such that each of the filter gain values for a segment of the decoded audio signal is indicative of a quantization noise filter gain for frequency components of the decoded audio signal in a different frequency band of said segment, and each filter gain value of the filter gain values is determined from a corresponding one of the signal to noise values by mapping said one of the signal to noise values to the filter gain value in accordance with a predetermined non-decreasing function of the signal to noise values, and wherein the adaptive quantization noise filtering applies quantization noise filtering to frequency components of each frequency band of least one segment of the decoded audio signal to reduce quantization noise in said each frequency band to a degree determined by the one of the filter gain values which corresponds to said each frequency band.

3. A method, including the steps of:

(a) decoding an encoded audio signal indicative of encoded audio content to generate a decoded audio signal indicative of a decoded version of the audio content; and (b) performing adaptive quantization noise filtering on the decoded audio signal in response to data indicative of signal to noise values, where the signal to noise values are indicative of a post-quantization, signal-to-quantization noise ratio for each frequency band of at least one segment of the encoded audio content, wherein the decoded audio signal is indicative of decoded frequency components, and step (b) includes steps of:

(c) determining filter gain values in response to the signal to noise values, wherein the filter gain values are indicative of quantization noise filter gains for the decoded frequency components; and (d) adaptively applying a non-adaptive filter to the decoded audio signal in response to the filter gain values, wherein step (d) includes steps of:

applying the non-adaptive filter to the decoded audio signal to generate a non-adaptively filtered audio signal; and in response to the non-adaptively filtered audio signal and the filter gain values, generating a quantization noise filtered audio signal indicative of a sequence of adaptively quantization noise filtered values.

4. The method of claim 3, wherein the signal to noise values are bit allocation values, the decoded audio signal is indicative of decoded frequency components, and each of the bit allocation values is indicative of a number of mantissa bits of at least one of the decoded frequency components.

5. The method of claim 4, wherein step (b) includes a step of adaptively applying a non-adaptive post-filter to the decoded audio signal in response to the bit allocation values.

6. The method of claim 3, wherein the decoded frequency components have values Y[k], the filter gain values are α[k], and the non-adaptively filtered audio signal is indicative of a sequence of non-adaptively filtered values, Y'[k], where k is indicative of frequency band, and wherein the quantization noise filtered audio signal is indicative of a sequence of adaptively quantization noise filtered values, Z[k], where each of the values Z[k] is at least substantially equal to $$Z[k]=\alpha[k]Y[k]+(1-\alpha[k])Y'[k]$$

for each frequency band k of at least one segment of said quantization noise filtered audio signal.

7. The method of claim 3, wherein the encoded audio signal is indicative of the signal to noise values, and also including a step of parsing the encoded audio signal to generate said data indicative of the signal to noise values.

8. A method, including the steps of:

(a) decoding an encoded audio signal indicative of encoded audio content to generate a decoded audio signal indicative of a decoded version of the audio content; and (b) performing adaptive quantization noise filtering on the decoded audio signal in response to data indicative of signal to noise values, where the signal to noise values are indicative of a post-quantization, signal-to-quantization noise ratio for each frequency band of at least one segment of the encoded audio content, wherein the decoded audio signal is indicative of decoded frequency components, and step (b) includes steps of:

(c) determining filter gain values in response to the signal to noise values, wherein the filter gain values are indicative of quantization noise filter gains for the decoded frequency components; and (d) adaptively applying a non-adaptive filter to the decoded audio signal in response to the filter gain values, wherein each of the filter gain values is determined from a corresponding one of the signal to noise values, by mapping said corresponding one of the signal to noise values to said each of the filter gain values in accordance with a predetermined non-decreasing function of the signal to noise values.

9. An audio signal processing system, including:

a decoding subsystem coupled and configured to decode an encoded audio signal indicative of encoded audio content to generate a decoded audio signal indicative of a decoded version of the audio content; and a filtering subsystem coupled and configured to perform adaptive quantization noise filtering on the decoded audio signal in response to data indicative of signal to noise values, where the signal to noise values are indicative of a post-quantization, signal-to-quantization noise ratio for each frequency band of at least one segment of the encoded audio content, wherein the adaptive quantization noise filtering is or includes generation of a quantization noise filtered signal indicative of a sequence of adaptively quantization noise filtered values for each said segment, where the sequence of adaptively quantization noise filtered values is an adaptively varied linear combination of non-filtered frequency components of the decoded audio signal and non-adaptively post-filtered frequency components of the decoded audio signal.

10. An audio signal processing system, including:

a decoding subsystem coupled and configured to decode an encoded audio signal indicative of encoded audio content to generate a decoded audio signal indicative of a decoded version of the audio content; and a filtering subsystem coupled and configured to perform adaptive quantization noise filtering on the decoded audio signal in response to data indicative of signal to noise values, where the signal to noise values are indicative of a post-quantization, signal-to-quantization noise ratio for each frequency band of at least one segment of the encoded audio content, wherein the filtering subsystem includes:

a filter gain determination subsystem, coupled and configured to determine filter gain values in response to the signal to noise values, such that each of the filter gain values for a segment of the decoded audio signal is indicative of a quantization noise filter gain for frequency components of the decoded audio signal in a different frequency band of said segment, and each filter gain value of the filter gain values is determined from a corresponding one of the signal to noise values by mapping said one of the signal to noise values to the filter gain value in accordance with a predetermined non-decreasing function of the signal to noise values, and wherein the filtering subsystem is coupled and configured to apply quantization noise filtering to frequency components of each frequency band of least one segment of the decoded audio signal to reduce quantization noise in said each frequency band to a degree determined by the one of the filter gain values which corresponds to said each frequency band.

11. An audio signal processing system, including:

a decoding subsystem coupled and configured to decode an encoded audio signal indicative of encoded audio content to generate a decoded audio signal indicative of a decoded version of the audio content; and a filtering subsystem coupled and configured to perform adaptive quantization noise filtering on the decoded audio signal in response to data indicative of signal to noise values, where the signal to noise values are indicative of a post-quantization, signal-to-quantization noise ratio for each frequency band of at least one segment of the encoded audio content, wherein the decoded audio signal is indicative of decoded frequency components, and the filtering subsystem includes:

a filter gain determination subsystem, coupled and configured to determine filter gain values in response to the signal to noise values, such that the filter gain values are indicative of quantization noise filter gains for the decoded frequency components; and a second subsystem, coupled and configured to adaptively apply a non-adaptive filter to the decoded audio signal in response to the filter gain values, wherein the second subsystem is coupled and configured to:

apply the non-adaptive filter to the decoded audio signal to generate a non-adaptively filtered audio signal; and in response to the non-adaptively filtered audio signal and the filter gain values, generate a quantization noise filtered audio signal indicative of a sequence of adaptively quantization noise filtered values.

12. The system of claim 11, wherein the signal to noise values are bit allocation values, the decoded audio signal is indicative of decoded frequency components, and each of the bit allocation values is indicative of a number of mantissa bits of at least one of the decoded frequency components.

13. The system of claim 12, wherein the filtering subsystem is coupled and configured to adaptively apply a non-adaptive post-filter to the decoded audio signal in response to the bit allocation values.

14. The system of claim 11, wherein the decoded frequency components have values Y[k], the filter gain values are α[k], and the non-adaptively filtered audio signal is indicative of a sequence of non-adaptively filtered values, Y'[k], where k is indicative of frequency band, and wherein the quantization noise filtered audio signal is indicative of a sequence of adaptively quantization noise filtered values, Z[k], where each of the values Z[k] is at least substantially equal to $$Z[k]=\alpha[k]Y[k]+(1-\alpha[k])Y'[k]$$

for each frequency band k of at least one segment of said quantization noise filtered audio signal.

15. The system of claim 11, wherein the encoded audio signal is indicative of the signal to noise values, and wherein the decoding subsystem is coupled and configured to parse the encoded audio signal to generate said data indicative of the signal to noise values.

16. The system of claim 11, wherein said system is a decoder.

17. The system of claim 11, wherein the decoding subsystem is a decoder, and the filtering subsystem is a post-filter coupled to the decoder.

18. An audio signal processing system, including:

a decoding subsystem coupled and configured to decode an encoded audio signal indicative of encoded audio content to generate a decoded audio signal indicative of a decoded version of the audio content; and a filtering subsystem coupled and configured to perform adaptive quantization noise filtering on the decoded audio signal in response to data indicative of signal to noise values, where the signal to noise values are indicative of a post-quantization, signal-to-quantization noise ratio for each frequency band of at least one segment of the encoded audio content, wherein the decoded audio signal is indicative of decoded frequency components, and the filtering subsystem includes:

a filter gain determination subsystem, coupled and configured to determine filter gain values in response to the signal to noise values, such that the filter gain values are indicative of quantization noise filter gains for the decoded frequency components; and a second subsystem, coupled and configured to adaptively apply a non-adaptive filter to the decoded audio signal in response to the filter gain values, wherein the filter gain determination subsystem is configured to determine each of the filter gain values from a corresponding one of the signal to noise values, by mapping said corresponding one of the signal to noise values to said each of the filter gain values in accordance with a predetermined non-decreasing function of the signal to noise values.

19. An audio signal processing system, including:

a decoding subsystem coupled and configured to decode an encoded audio signal indicative of encoded audio content to generate a decoded audio signal indicative of a decoded version of the audio content; and a filtering subsystem coupled and configured to perform adaptive quantization noise filtering on the decoded audio signal in response to data indicative of signal to noise values, where the signal to noise values are indicative of a post-quantization, signal-to-quantization noise ratio for each frequency band of at least one segment of the encoded audio content, wherein the decoded audio signal is indicative of decoded frequency components, and the filtering subsystem includes:

a filter gain determination subsystem, coupled and configured to determine filter gain values in response to the signal to noise values, such that the filter gain values are indicative of quantization noise filter gains for the decoded frequency components; and a second subsystem, coupled and configured to adaptively apply a non-adaptive filter to the decoded audio signal in response to the filter gain values, wherein the encoded audio signal is indicative of filter coefficients of the non-adaptive filter, and wherein the decoding subsystem is coupled and configured to parse the encoded audio signal to extract the filter coefficients therefrom, and to provide said filter coefficients to the second subsystem to configure said second subsystem to apply said non-adaptive filter.

* * * * *